United States Patent [19]

Bröcking

[11] 4,261,145

[45] Apr. 14, 1981

[54] SPACER FOR DOUBLE-PANE AND MULTIPLE-PANE WINDOWS AND METHOD AND APPARATUS FOR MAKING SAME

[76] Inventor: Hans Bröcking, Am Handweiser 3b, 5600 Wuppertal 1, Fed. Rep. of Germany

[21] Appl. No.: 951,156

[22] Filed: Oct. 13, 1978

[30] Foreign Application Priority Data

Oct. 15, 1977 [DE] Fed. Rep. of Germany ..... 27446607
Jul. 5, 1978 [DE] Fed. Rep. of Germany ..... 2829444

[51] Int. Cl.[3] ..... F06B 7/12

[52] U.S. Cl. ..... 52/172; 52/656; 29/428; 29/525; 72/149

[58] Field of Search ..... 52/171, 172, 656, 658; 72/216, 217, 149; 29/428, 525

[56] References Cited

U.S. PATENT DOCUMENTS

| | | | |
|---|---|---|---|
| 2,286,255 | 6/1942 | Brooks | 72/149 |
| 2,341,178 | 2/1944 | Duer | 72/217 |
| 2,570,169 | 2/1951 | Verhagen | 52/656 |
| 2,634,867 | 4/1953 | Shields | 52/658 |
| 2,782,832 | 2/1957 | Shaw | 72/216 |
| 2,877,516 | 3/1959 | Bobel | 52/172 |
| 3,226,903 | 1/1966 | Lillethun | 52/172 |
| 3,553,913 | 1/1971 | Eisenberg | 52/172 |
| 3,758,996 | 9/1973 | Bowser | 52/172 |
| 3,866,380 | 2/1975 | Benson | 52/656 |

FOREIGN PATENT DOCUMENTS

| | | | |
|---|---|---|---|
| 380259 | 9/1932 | United Kingdom | 52/656 |
| 590954 | 8/1947 | United Kingdom | 52/656 |
| 649459 | 1/1951 | United Kingdom | 52/172 |
| 1159001 | 7/1969 | United Kingdom | 52/172 |

*Primary Examiner*—James L. Ridgill, Jr.
*Attorney, Agent, or Firm*—Karl F. Ross

[57] ABSTRACT

A spacer for double- and multi-paned windows, e.g. insulating windows in which at least two panes of transparent material, e.g. glass, are spaced apart by a peripheral spacer so as to constitute an insulating window structure, comprises a spacer which is constituted as a frame from hollow profile members along whose both lateral outer faces the glass panes lie. The inwardly disposed profile walls are substantially planar and the interior of the frame can be filled with a drying agent capable of absorbing moisture or preventing penetration of moisture. The spacer is constituted from a plurality of extrusion-pressed profiled tubes which in the region of the frame corners are bent and are connected at least at one location, to a straight frame side along the side intermediate the bent corners, thereby reducing the sensitivity of the assembly to the penetration of moisture into the space between the panes.

14 Claims, 17 Drawing Figures

FIG. 4
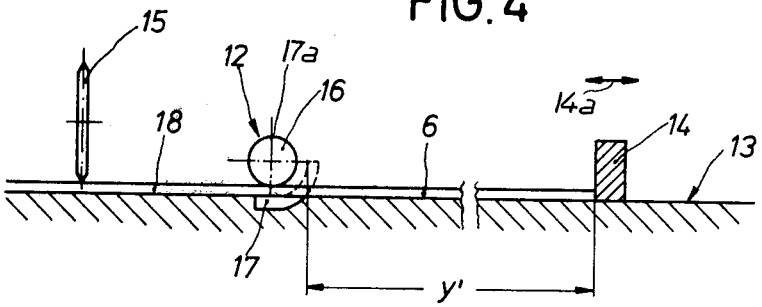
FIG. 5
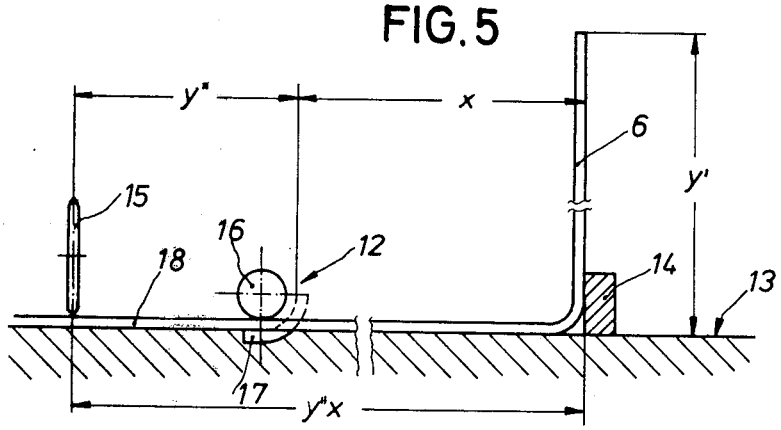
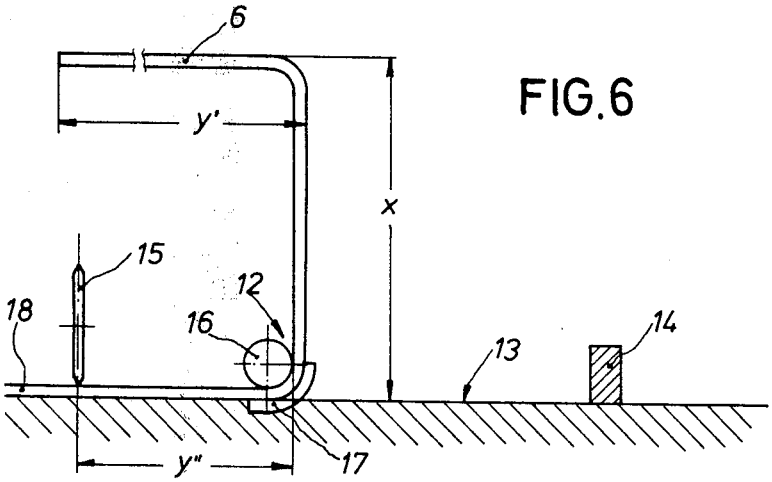
FIG. 6

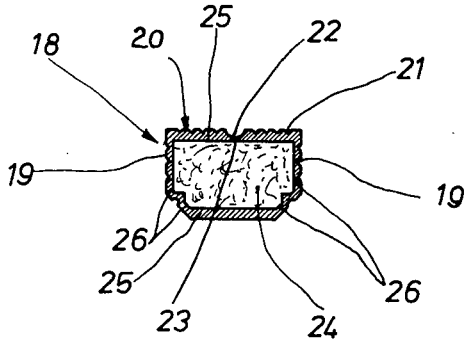
FIG. 7
FIG. 8
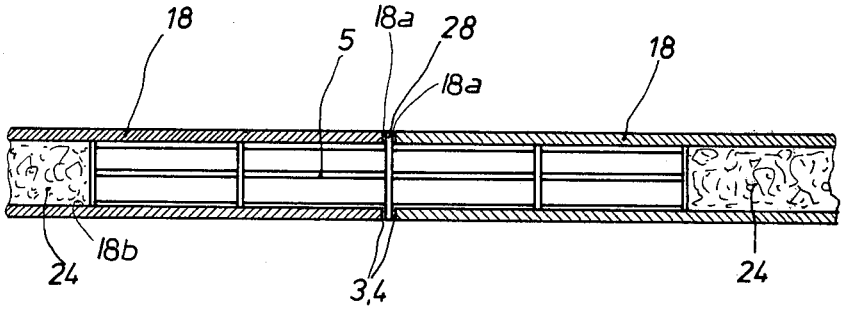
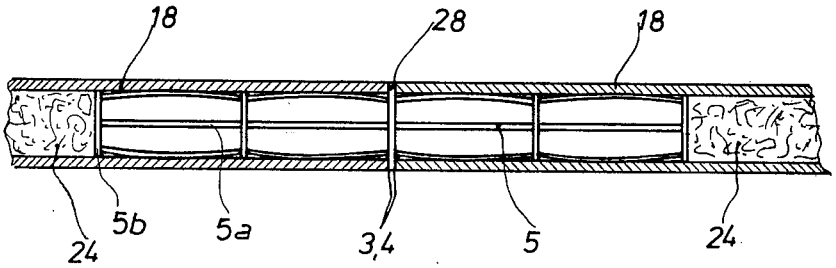
FIG. 9

SPACER FOR DOUBLE-PANE AND MULTIPLE-PANE WINDOWS AND METHOD AND APPARATUS FOR MAKING SAME

FIELD OF THE INVENTION

The invention relates to a spacer for double-pane and multi-pane glass or other windows and to a method of making such spacers. More particularly, the invention relates to the production of spacers of the type used in assembling insulating glass windows of the double-pane or multi-pane type and to the assembly fabricated with the improved spacer of the present invention.

BACKGROUND OF THE INVENTION

For insulating purposes, especially in this period of great sensitivity toward energy waste, double-pane and multi-pane windows are of paramount importance to prevent loss of heat or incursion of heat through the portion of a structure wall provided with the window.

It is thus known to provide an insulated window structure having two or more transparent panes, usually of glass, which are separated by a dead air space defined between the panes with the aid of a peripheral spacer. In other words, the two panes are held apart by a spacer and lie against the opposite planar walls of the spacer which are turned outwardly.

The spacer generally consists of a frame of hollow profiles which are joined together and have planar outwardly turned faces against which the glass panes lie. The inwardly turned profile walls are substantially flat or planar as well. The walls of the profile may have crevices and the hollow interior thereof can receive a drying agent capable of absorbing moisture.

Systems of the latter type are provided, for example, in German Federal Republic Pat. Nos. 1,434,175 and 1,509,170. In these systems, the hollow profiles are joined into a frame by specially designed corner connectors and a problem has been encountered with these systems in that the connection between the glass panes and the frame cannot be completely sealed at the corner regions to prevent penetration of moisture into the space between the panes and defined by the spacer frame. The hollow interior is filled with a dried gas, for example air, and the penetration of moisture is largely prevented by the sealing materials to prevent condensation within the interior of the window, e.g. along the inner faces of the glas panes.

Surprisingly, while it is possible to adequately seal the panes to the frame along the rectilinear portions of the latter, i.e. the major portions of the sides thereof, using an appropriate adhesive or sealer, the seal at the corners does not appear to be as effective and the corner regions thus permit more or less moisture to penetrate.

It has been sought, e.g. by the proposal of German Federal Republic Pat. No. 1,509,170, to obviate this disadvantage by beveling the corner-connecting angle and providing a thicker deposit of the sealing mass in this region. This attempt is designed to increase the length over which diffusion must occur from the exterior into the enclosed space of the window.

In practice, this has proved to be largely unsuccessful and even attempts by the use of additional adhesive materials, soldering or like treatments to seal the corner regions have proved to be unsuccessful either as a result of their extraordinarily high cost or their unsatisfactory ability to effect a truly hermetic seal.

OBJECTS OF THE INVENTION

It is the principal object of the present invention to provide an improved spacer for a double-pane or multi-pane assembly of the character described which can be used with reduced assembly and sealing cost, affords better resistance to moisture penetration, especially in the corner regions, and which possesses even in the corner regions of the frame, a corresponding resistance to penetration to moisture as is found along the remainder of the rectilinear sides thereof.

It is another object of the invention to improve upon a and a double-pane or multi-pane insulating window assembly utilizing same so that the drawbacks enumerated above are avoided.

A further object of the invention is to provide an improved method of making a spacer and hence an improved method of making a double-pane or multi-pane window assembly for the purposes described.

SUMMARY OF THE INVENTION

The invention is based upon my surprising discovery that the system of German Federal Republic Pat. No. 1,501,170 can be improved upon greatly by forming the spacer of at least one extrusion-pressed profile tube which is bent in the region of the frame corners and is assembled at at least one abutting joint with a straight section along a straight side of the frame. This frame has the aforementioned outwardly turned mutually parallel planar surfaces against which the transparent panes, generally of glass, are applied and are bonded, as well as an interior space between inwardly turned walls which can be formed with crevices, grooves or the like and which receives the drying agent or desiccant.

According to the invention, the corner connectors of the prior art are completely avoided.

According to one aspect of the invention and in a particularly advantageous embodiment thereof, constituting the best mode for carrying out the invention in practice, the spacer consists of at least two extrusion-pressed profile tubes bent in the region of the frame corners whose abutment joints (butt joints) are aligned by rectilinear connecting elements which are received in the tube ends instead of the drying agent in the region of the joints. The butt joints on opposite frame portions are offset from one another and are spaced from the nearest frame corner by the same distance. In this case, the frame members can all be of identical configuration.

Of course, additional abutting joints can be made with the use of profile tube sections which can be rectilinear.

According to the invention, the tube defines a peripherally closed space which is filled with the moisture absorbent except possibly in the regions of the butt joints as noted, the communication between the interior of the tube and the space defined between the panes being effected by openings spaced apart in the tube wall.

In another embodiment of the invention, the spacer frame can be constituted from a single extrusion-pressed tubular member which is bent, with rounded corners, to the configuration of the pane and the ends of which tube are joined in the aforementioned butt joint substantially in the center of one of the straight frame sides, the joint being sealed by any conventional means.

In yet another embodiment of the invention, the frame is assembled from rectilinear frame members and corner members, each of the corner members being an extrusion-pressed profile of peripherally closed tubular configuration and filled with the drying agent, the drying agent being inserted into the extrusion-pressed profile tube prior to bending to maintain the shape of the tubular profile. This ensures that the outer flanks of the tubular profile will remain planar and seal effectively to the panes or any frame forming part of the assembly and externally engaging the latter. The butt joints should be spaced sufficiently from the curved portions of the corner members so that the corner members are under minimal stress. At the butt joints, these corner members are connected to the rectilinear members, the joints, of course, lying at the straight sides of the frame.

It is thus not only possible to seal the butt joints by conventional means, but to use connecting elements, preferably of synthetic resin, to center the corner members and the linear members to which they are connected relative to one another. In the region of these joints, the synthetic-resin centering or connecting elements can be fitted tightly in the tube ends in place of the drying agent so as to prevent mobility of the drying agent within the corner members and to effect alignment without deformation of the extrusion-pressed tubes. The drying agent need not be provided in the tube ends which are removed from the curved portions of the corner members since in these regions there is no deformation of the extrusion-pressed tubes during the bending operation. Since all of the corner members can have the same configuration and can be constituted from successive lengths cut from one and the same extrusion-pressed profile tube, the tube ends at the abutment joints can be especially tight and sealingly connected with one another. Naturally, the straight lengths can also be cut from the same extrusion-pressed profile tube.

According to another feature of the invention, the extrusion-pressed profile tube has a substantially rectangular cross section with outer edges (with respect to the frame) which are sharply set inwardly with respect to the planar outer flanks against which the panes lie. This cross-sectional configuration ensures on the one hand that there will be the planar surfaces adapted to lie against the panes and, on the other hand, that wedge-shaped or inwardly convergent spaces will be provided for the sealing compound or composition along the external periphery of the frame. Furthermore, the setback edges just described have been found to facilitate the bending process. Naturally, the system of the present invention can make use of other tubular cross sections, for example, a half-round cross section to form the spacer and yet provide the desired spaces for the sealing composition.

According to the invention, moreover, the frame should have a configuration such that the bending radius (radius of curvature) of the corner portions of the extrusion-pressed profile tube is such that the bent region is completely covered by the external frame of the window and thus is not visible from the exterior. The external frame thus may have aprons overlying the glass panes along the periphery thereof which extend inwardly sufficiently to cover the bent regions.

According to another aspect of the invention, a process for making the spacer frame comprises extrusion-pressing a profile tube and advancing the extrusion-pressed profile tube in a bending plane along the bending apparatus until the tube engages an abutment whose spacing from the bending mandrel is equal to the desired spacing of a joint location from a neighboring bend. The stretch of the tube between the bending device and the abutment or stop is then bent curvilinearly to 90° to the remainder of the extrusion-pressed profile tube and the latter is again advanced in the bending plane until the first bend engages the abutment spaced from the bending device by the length of a frame side. The tube is again bent through 90° and the second curvilinear bend is formed. The resulting doubly bent section is then severed from the balance of the tube at a location corresponding to the distance of the second butt joint from the bend. The sum of the lengths of the tube between the respective bends to the free ends of the section can be equal to the length of another side of the frame.

It has been found to be especially advantageous to carry out the bending and severing operations with two extrusion-pressed tubes in side-by-side and mutually contiguous relation, the tube sections thus resulting being assembled into a frame at two butt joints. In this case, the two sections are of U-configuration and have shanks of unequal lengths but can be assembled by mirror-symmetrical orientation with the butt joints offset from one another on opposite sides of the frame.

Since the stops are adjustable, it is possible to carry out the process of the present invention to form two exactly identical U-shaped frame halves with equal shank lengths so that the butt joints between the two frame halves will lie in the center between two opposite frame parts and in alignment with one another along a plane perpendicular to the plane of the frame.

When the system of the present invention is used to form corner members only, it is merely necessary to advance the extrusion-pressed tube against the abutment and form single bends which are then cut from the tube. The bent corner members can then be assembled with exactly dimensioned straight lengths of the extrusion-pressed profile tube to produce the frame. Here again the shape of the frame can be improved as to precision each time two extrusion-pressed profile tubes in side-by-side contiguous relation are bent and cut simultaneously.

According to another feature of the invention, which has been found to be important for effective shaping of the bends, the bending process is effected in a plane inclined to the horizontal, preferably at about 30°.

The extrusion-pressed tube is slid along this inclined-plane surface in which bending is effected and it has been found that the incline gives minimum resistance to both the bending and the movement of the tubular parts therealong. This makes it possible to utilize the tubular lengths practically without waste. Even when lengths of tubing shorter than is desired result, they may be connected with the aforementioned connecting elements to earlier lengths ahead of them on the inclined table without difficulty provided the butt joint between these parts does not fall at a bend.

In another embodiment of the method aspect of the invention, there is provided a vibration concurrently with the separation or cutting or the extrusion-pressed tube which is effected in the region of the cut so that the drying agent is vibrated out of the tube end to provide a place for the introduction of the connecting or aligning element. Naturally, in accordance with the present invention, the entire extrusion-pressed tube can be filled with the drying agent, i.e. packed tightly therewith, so that the drying agent supports the walls of the tube during bending.

The vibration has a further advantage in that the connection of the bent spacer member can be formed into the frame directly on the inclined bending table by assembly with other bent members and, if desired, straight members as described. This prevents warping of the frame during the assembly process as can result when the bent frame elements must be transported elsewhere and retained by other members during the assembly.

BRIEF DESCRIPTION OF THE DRAWING

The above and other objects, features and advantages of the present invention will become more readily apparent from the following description, reference being made to the accompanying drawing in which:

FIG. 4 is a cross-sectional view in diagrammatic form through an apparatus for bending the frame members according to the invention in one position;

FIG. 5 is a view similar to FIG. 4 showing the apparatus during a second stage;

FIG. 6 is a view similar to FIG. 4 showing the apparatus in still a third stage of the bending operation;

FIG. 7 is a cross-sectional view, drawn to an enlarged scale, through an extruded profile tube forming a frame in accordance with the present invention, e.g. representing the profile of the tube used in FIGS. 1–6;

FIG. 8 is a vertical cross section through a joint between two extrusion-pressed profile tubes and illustrating, for example, one of the joints shown in FIGS. 1–3;

FIG. 9 is a horizontal section through the joint;

SPECIFIC DESCRIPTION

Figure 1:
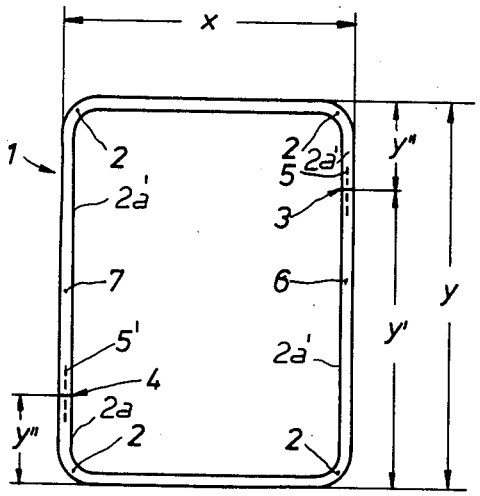
FIG. 1 is an elevational view of a spacer frame with mutually offset butt joints according to a preferred or best-mode embodiment of the invention.

The frame 1 shown in FIG. 1 is constituted from bent frame corner members 2 and linear portions interconnecting these corners.

Each one of the two frame members 6 and 7 constituting the frame 1, comprises a pair of corners 2 and respective shanks 2*a* and 2*a'* of different length. The two members 6 and 7 are identical and are disposed in mirror-symmetrical relationship so that the shank 2*a* of one member adjoins the shank 2*a'* of the other at respective joints 3 and 4. Connecting elements 5 and 5' bridge these joints within the extrusion-pressed tubes as will be described in greater detail hereinafter, the tubes otherwise abutting one another.

The frame members 6 and 7 are, as has been noted, constituted from an extrusion-pressed profile tube which can be bent and cut in the manner described in connection with FIGS. 4–6 or otherwise below. The tube can have the cross section shown in FIG. 7.

The interior of the tube is filled with a drying agent or desiccant 24, e.g. silica gel, which is filled into the tube before the bending thereof. The radius of curvature of the bent frame corners 2 is so selected that the corners of the glass panes overlap these bends and the entire corner region can be filled with a sealing composition or the like. Sealing is provided in the region of the butt joints 3 and 4 as well.

In the embodiment of FIG. 1, the frame halves 6 and 7 are so bent that the butt joints 3 and 4 are each the identical distance y'' from the nearest frame corner 2 and a distance y' from the furthest frame corner along the same side of the rectangular frame. In other words, the shanks 2*a* have the length y'' measured from the remote end of the nearest bend 2 while the shanks 2*a'* have the length y' measured in a similar manner.

It is thus possible to bend the two frame members 6 and 7 simultaneously and one beside the other and then to rotate one of the two frame members through 180° from its bending location to position the frame members in a common plane and allow them to be interconnected. The side length y of the frame is thus the total of the shank lengths y' and y'' while the width of the frame is represented at x.

Figure 2:
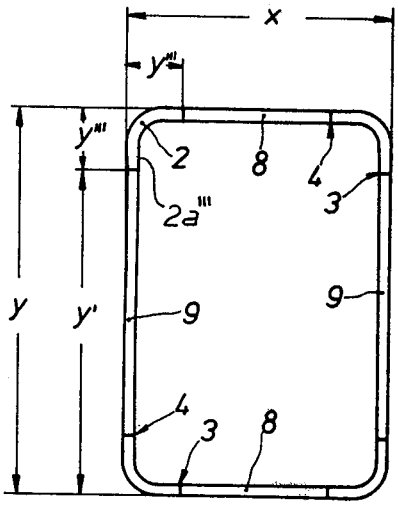
FIG. 2 is an elevational view representing a modification of FIG. 1 in which the butt joints are provided between corner members and straight members according to the invention.

In subsequent Figures, parts with identical functions will be given corresponding reference numerals and hence, in FIG. 2, the frame is shown to be constituted of four identical corner members 2 each having a respective bend and a pair of relatively short shanks 2*a'''* having a shank length y'''. The remaining length y' is filled by the shank of another corner and a straight length 9 of the same extrusion-pressed tubing. The short side is made up of shorter lengths 8 of the extrusion-pressed tubing which join the other shanks of the corners 2. Thus, in this embodiment, the frame is made up of the corner members 2 and straight lengths of the same extrusion-pressed tubing 8, 9 which are connected to the corner members via similar butt joints 3, 4 as has been described. In this embodiment, there are eight such butt joints, all of which can be sealed in the usual manner and can be provided with centering elements as has been represented at 5.

The shank lengths y''' are so selected that they extend sufficiently beyond the bend that there is no cross-sectional change in the tubing at the region of the butt joints 3, 4 resulting from the bending operation.

Figure 3:
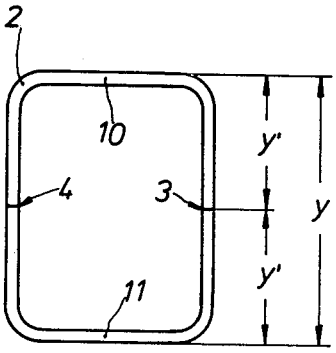
FIG. 3 is another elevational view representing a further modification of the spacer frame in which the butt joints are provided directly opposite one another between two U-shaped frame members with equal-length shanks.

Still another variant of the invention has been represented in FIG. 3 in which two U-shaped frame parts 10 and 11 have equal shank lengths y' on both sides and are mirror-symmetrically disposed with respect to one another to form two butt joints 3, 4 directly opposite one another. These frame parts 10 and 11 can also be bent simultaneously as will be described hereinafter. The butt joints 3 and 4 can be formed with the connecting and centering elements 5 which have already been mentioned.

FIGS. 4–6 show the successive operations in the formation of a spacer frame of the type illustrated in FIG. 1.

As can be seen from these Figures, an extrusion-pressed profile tube 18 is displaced along a guide surface 13 until it engages an abutment or stop 14, the latter being adjustable along the work table 13 as represented by the arrow 14*a* relative to the bending station 12.

The bending station 12 comprises a bending mandrel, here represented as a roll 16, and a bending tool 17 which is swingable about the center 17*a* of this roll to impart curvature to the length 6 of the tube projecting beyond the bending roll 16.

When the bending tool 17 is swung through 90° about the mandrel 16 in the counterclockwise sense (see the broken-line path in FIG. 4), the tube length between the mandrel 16 and the stop 14 is bent upwardly through 90°. Since the tube has previously been filled with the drying agent, this bending is effected without collapse of the walls of the tube.

The spacing between the bending device and the stop 14 is here shown to be the dimension y′ corresponding to the shank length of the shank 2*a* (FIG. 1).

Naturally, on the opposite side of the bending device 16, the profile tube 18 is held against movement.

After the first bending step has been completed, the stop 14 is shifted relative to the bending device 16 so that the length between a cutting tube 15 and the stop 14 is the sum of x and y″ corresponding to the total width of the frame plus the other shank length. The tool 17 is again swung in the counterclockwise sense after the upwardly bent shank has been brought into contact with the stop 14 so that another 90° bend is formed as shown in FIG. 6. At a distance y″ from the bending device, the saw blade 15 cuts the tube 18 to separate the member 6 from the length of the extrusion-pressed tube.

It has been found to be advantageous to maintain the distance y″ of the saw blade 15 from the bending unit 12 constant and to adjust the length and width of the frame by setting the dimensios x and y′ with the aid of the movable stop 14. Conventional means may be provided to guide the stop 14 and allow its precise positioning along the guide path 13 so that the frames can be manufactured with the desired narrow tolerances. Naturally, FIGS. 4–6 are intended to show the bending operation for two such tubes in side-by-side (laterally coextensive) relationship.

According to the principles of the present invention, the height and width of the frame can be provided with electrical or electronic control, e.g. by numerical control of the stop 14. In other words, a decade switch can be provided for the x and y axes of movement of the member 14 and the values to be recorded in the numerical controller can be obtained by testing or by calculation.

For serial or mass production of the frames, I have found it to be advantageous to provide a perforated-tape reader controlling the two axes which can be provided with correcting circuitry (servocontrolled circuitry) so that by setting the frame size, the stop 14 is moved into a corresponding position. The drive for the stop 14 can be a servomotor with a rapid (coarse) and slow (fine) speed or adjustment.

The position of the stop 14 and its advance or retreat from a particular position can be detected by an angle-stepping transmitter or by any other feedback means.

The problem in the bending of extrusion-pressed profile tubes 18 is that it is necessary in the region of the bent frame corners 2 (see FIG. 1) to prevent deformations from arising that preclude a flat contact of the glass panes with the lateral planar outer faces 19 of the tube. The extrusion-pressed profile tube 18 is provided along its generally flat inner profile walls 20 with longitudinally extending extending channels 21 which have a substantially decorative character and thus need not be used. In the center of the outer surface, there are provided throughgoing relatively deep and wall-weakening channels 22. In the latter, thin-walled, section there are provided a multiplicity of fine openings 23, e.g. perforations, permitting communication between the air space defined between the panes and the drying agent 24. The channel 22 can also be formed on the inner side of the wall 20 if desired.

The extrusion-pressed profile tube 18 shown in FIG. 7 is provided with thickened wall regions 25 and thin-wall regions 26 which facilitate bending of the tube while maintaining the outer surfaces 19 in respective planes. The weakened wall region 26 prevents any lateral bulging of the surfaces 19.

The material from which the extrusion-pressed profile tubes 18 are formed is preferably the alloy AlMgSi 0.5. This aluminum-magnesium-silicon alloy can be subjected to a conventional heat treatment to facilitate crack-free bending of the extrusion-pressed hollow profile. The tube can also be provided with the necessary perforations or slits in the thin-wall channel 22.

FIGS. 8 and 9 show vertical and horizontal cross sections through frame parts in the region of the butt joints 3 or 4. As can be seen from these Figures, commercial connecting elements 5 are fitted snugly in the ends of the individual tube sections 18 which have been emptied of the drying agent 24, e.g. by vibration in the manner to be described below. The connecting and centering elements 5 are shown to have a transverse flange whose external periphery corresponds to the external periphery of the individual tubes and which is fitted snugly and sealingly between the ends 18*a* thereof. In general, the connecting element 5 may have longitudinally extending ribs 5*a* which are press-fitted into the interior of the tubes and are spaced apart by transverse flanges 5*b* which likewise have a configuration corresponding to the internal cross section of the internal passage 18*b* of the tube. The connecting element 5 thus acts as a plug for each end of the tube at the butt joint 3, 4 tending to prevent further migration of the desiccating agent 24.

It is important, as has been noted previously, to effect during the separation of each frame section from the tube 18, to provide a vibration whose intensity and duration is precisely determined to enable sufficient drying agent to be dislodged from the tube end created by the sawing operation that the connecting element 5 can be inserted without difficulty.

Since each of the connecting members or elements 5 is also a plug, the system shown in FIG. 8 enables a plug to be fitted into the cut end of frame section as as soon as it is bent upon the bending machine or table to provide a completely closed frame section.

Figure 10:
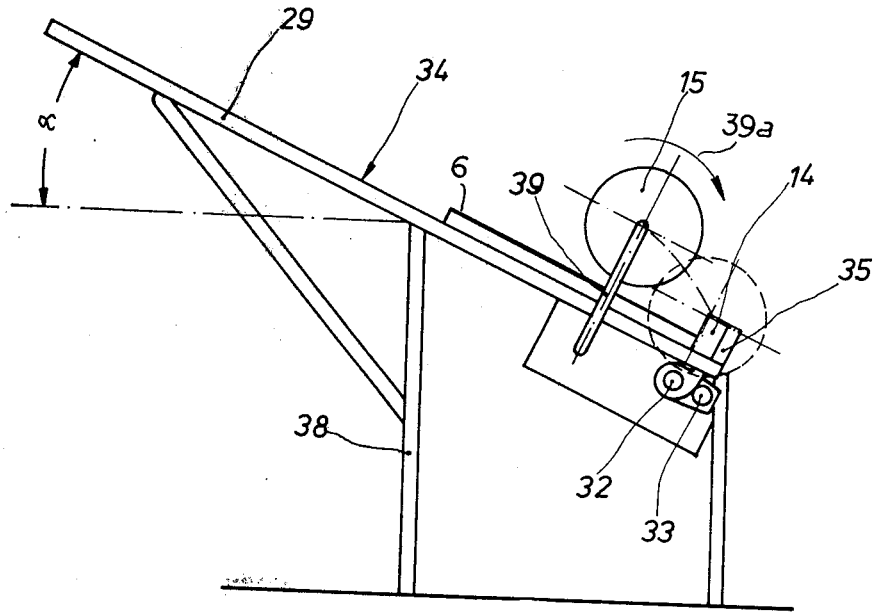
FIG. 10 is a side-elevational view of a bending apparatus with an inclined bending plane or work table for use in making the frame of FIGS. 1–3 using the tubing of FIGS. 7–9 and carrying out the process of FIGS. 4–6.
Figure 11:
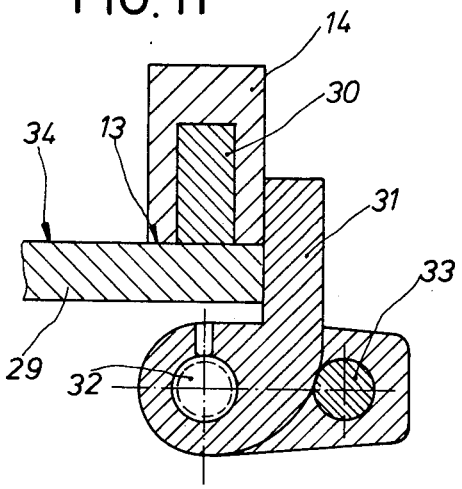
FIG. 11 is a partial cross-sectional view through a work table of the bending machine showing an abutment movably mounted thereon.

FIGS. 10 and 11 show a machine for the bending of the extrusion-pressed profile tubes 18 in accordance with the principle of the present invention. The work table 29 of the machine whose upper surface forms a bending plane 34 along which the tube is moved and upon which the frame parts 6 and 7 are bent, is inclined to the horizontal by an angle $\alpha$ of about 30°.

At the lower edge of the work table 29, there is provided a schematically indicated guide path 13 which is connected with and adjoins the bending plane 34 and along which the extrusion-pressed profile tube 18 is shifted.

In the embodiment of FIG. 11, the stop 14 is shiftable along this guide path or track 13 with the aid of a ball roller spindle 32, the stop 14 being affixed to a bracket or holder 31 which is displaced by the spindle 32 while being guided on a rod 33 to assure an exactly parallel displacement of the stop surface to itself. This stop surface is provided with a proximity switch 30 which detects the contact of the end of the tube 18 with the abutment.

The contact switch 30 is well known in the art and can trigger an electrical sequencing operation for carrying out the remainder of the bending operation. In this operation, the tube 18 which abuts the stop 14 is first clamped and the bending operation is effected, e.g. as described in connection with FIG. 4. The bending operation being completed, the tube 18 is released for the next operation.

Figure 12:
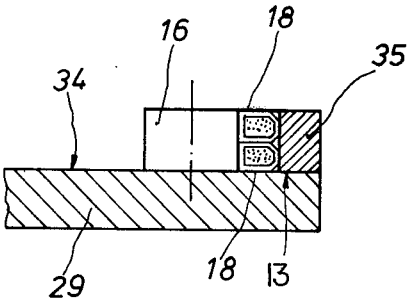
FIG. 12 is a longitudinal section through the work table in the region of the bending device.

From the simplified showing in FIG. 12, it is clear that two-extrusion-pressed profile tubes 18 in laterally contiguous and coextensive (side-by-side) relationship can be bent simultaneously.

FIG. 12 also shows a guide bar 35 which defines the guide path 13 for the tubing on the table 29 whose bending surface 34 can also be seen in this Figure. The guide means and clamping means which prevent the lifting of the extrusion-pressed profile tubes 18 from the table 29 are omitted to avoid obstructing the view of essential parts of the apparatus, but can be of any conventional design. Naturally, the guide bar 35 is so arranged and constructed that it does not obstruct the movement of the stop 14. The guide bar 35 and the mandrel 16 have heights sufficient to accommodate two tubes 18 one above the other.

Figure 13:
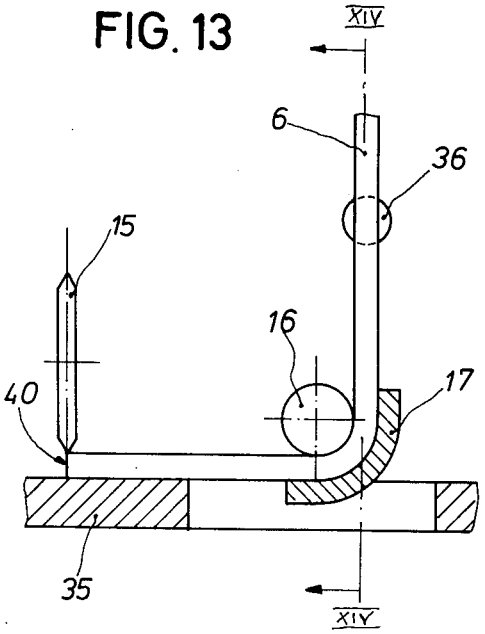
FIG. 13 is a plan view of the bending device in schematic form showing the vibrating element.
Figure 14:
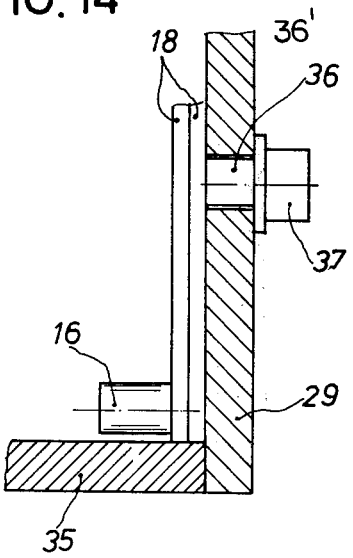
FIG. 14 is a cross section through the apparatus of FIG. 13 taken along line XIV—XIV thereof.

FIGS. 13 and 14 have been provided predominantly to show the vibrating device 36, 37, albeit schematically. In the plate or table 29 there is provided a vibrating pin 36 which is connected to a vibrator 37, e.g. a magnetic coil assembly whose armature actuates the pin 36, adapted to vibrate the latter perpendicular to the bending plane or surface 34 and whose free end face 36' engages the under side of the lowermost extrusion-pressed tube 18.

The vibrator 37 can thus be of conventional construction and is connected to the work table 29. However, it can also be provided upon a separate support to bear upon another surface of the extrusion-pressed profile tubes 18.

When the vibrating pin 36 is set into reciprocating movement along its longitudinal axis, the vibration is transmitted to the frame part 6 which is still held against the table so that the desiccant 24 is permitted to fall out of the free end 40 of the tube section after cutting by the saw 15. A collector can be provided below the saw to accumulate the discharged desiccant for re-use in the filling of another extrusion-pressed profile tube.

As has been noted, it has been found to be highly advantageous to incline the bending plane 34 of the table 29 to the horizontal at an angle $\alpha$ which can be about 30°. Naturally, it is possible to provide means on the support 38 for the table 29 enabling it to be adjusted as to its included angle $\alpha$ with the horizontal.

It has been found that this inclined orientation (see especially FIG. 10) allows pieces of the extrusion-pressed profile tube, too short to be bent into corner members, to be employed by enabling them to be assembled with the connecting elements 5 to corner members or other lengths of the tubing. The inclined orientation has been found to be especially effective when two or more bends are to be provided in each frame section of the tubing. It is only desirable to carry out the bending process so that no butt joint is included in the arcuate corner portion.

Naturally, while the preferred angle is about 30°, the system of the invention should not be considered to be limited to this angle since, in many cases, the user of the apparatus may find larger or smaller angles to be convenient.

The table 29 has a sufficiently large working area that even the largest bent frame sections 6, 7 can be accommodated and assembled and indeed such that the assembly can be effected without interfering with further bending. Preferably, the assembly is effected immediately after bending of two sections or the necessary number of corner sections so that the drying agent is not in unnecessary contact with ambient air for any prolonged period before the ends of the tubes are plugged. This prevents the moisture-pickup capacity of the drying agent from being reduced before it is to become effective in maintaining a low humidity in the space between the panes.

FIG. 10 also shows schematically that the sawblade 15 can be provided with a swing 39 which can also carry the drive motor (not shown) for this blade. This enables the sawing process illustrated in FIG. 6 to be achieved merely by a downward swing of the saw assembly (arrow 39*a*). This can also be effected by a sequencing circuit which only turns on the saw when the second bending step is completed and while the extrusion-pressed tube or tubes 18 remain clamped. The drive for the sawblade can be provided with a conventional blade-braking device for terminating rotation of the blade as soon as the sawing process is complete.

Figure 15:
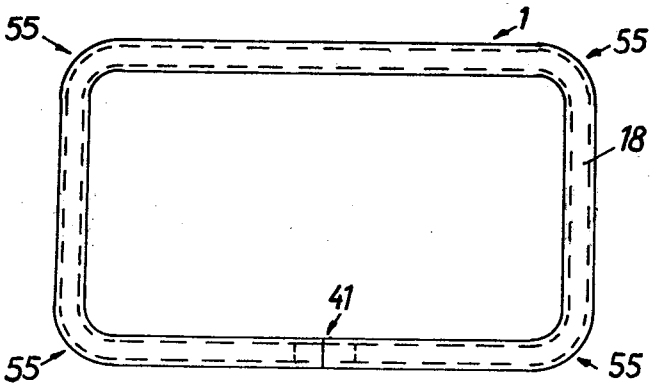
FIG. 15 is a plan view of another frame embodying the invention.

FIG. 15 shows a spacer 1 which is constituted from a single bent extrusion-pressed profile tube 18, the four corners 55 being bent in the manner described and the single butt joint 41 having the aforedescribed connecting element 5 and being sealed. In accordance with the principles of the invention, the butt joint 41 is provided in a straight length of the spacer frame. In this construction, as in the other embodiments of the invention, no corner connectors are required and the sealing of the window assembly is markedly improved.

Figure 16:
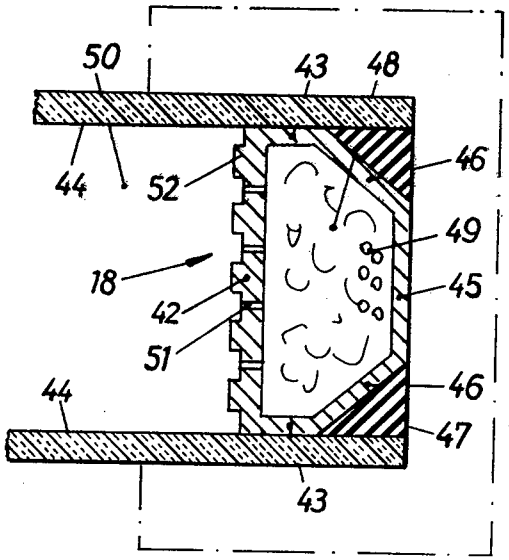
FIG. 16 is a cross section through this frame drawn to an enlarged scale.

In the construction illustrated in FIG. 16, the tube 18 is shown to have a generally rectangular cross section with a generally flat inwardly turned wall 42 whose channeled surface provides reduced-thickness regions provided with perforations 51 affording communication with the interior of the tube.

The planar, mutually parallel flanks 43 of the tube lie flat against the glass panes 44 and the outer wall 45 is provided with set-back inclined corner positions 46 which define wedge-shaped compartments with the glass panes receiving the sealing composition 47.

The hollow interior 48 of the tube is filled with the drying agent 49 which is designed to reduce the water vapor pressure in the space 50 between the panes 44 and the spacer 1. The ribs 52 between the channels are provided to improve the appearance and, if desired, to accommodate intermediate panes.

Figure 17:
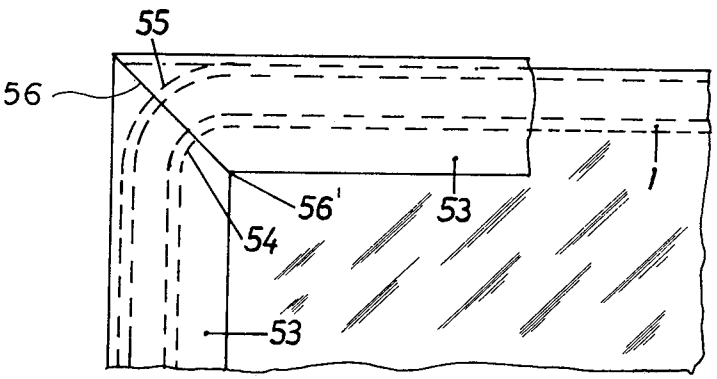
FIG. 17 is an elevational view of a corner of an assembly provided with an outer frame element in accordance with the present invention.

The window assembly shown in FIG. 17 may be enclosed in a frame represented in dot-dash lines and constituted in straight metal profiles 53 of U-section forming a mitered joint 56 of conventional design. The bending radius 54 of the corners of the frame 1 is dimensioned so that the shanks of the U completely overhang the frame and the corner region 55 is not visible from the exterior. Thus the corner 56' of the miter joint 56 lies inwardly of the spacer frame.

I claim:

1. A double-pane window assembly comprising a peripherally closed frame having parallel flat continuous lateral flanks adapted to have the panes rest flat thereagainst and constituted of an extrusion-pressed profile tube having arcuately bent corners and at least one butt joint between tube ends located along a straight side of the frame, a pair of rectangular panes resting flat against the respective flanks and defining a space between them, the tube being filled with a drying agent and having openings adapted to communicate between the interior of the tube and said space defined between the panes and surrounded by the frame, and a sealing composition flush with said frame bending said panes to said spacer.

2. The assembly defined in claim 1 wherein said frame comprises a plurality of corner members each having an arcuately bent portion and a pair of straight portions connected to said arcuately bent portions, and straight members interconnecting the straight portions of respective corner members and forming respective butt joints therewith solely along straight sides of the frame.

3. The assembly defined in claim 1 wherein said frame is constituted from a single length of extrusion-pressed profile tube.

4. The assembly defined in claim 1 wherein said frame comprises at least two extrusion-pressed profile tube sections each provided with two arcuately bent portions and separated by a straight length of the tube, said sections forming two butt joints on opposite sides of the frame.

5. The assembly defined in claim 4 wherein said butt joints are offset with respect to one another with each butt joint being at the same distance from the nearest corner as the other butt joint.

6. The assembly defined in claim 4 wherein both butt joints lie in a common plane perpendicular to the plane of said frame.

7. The assembly defined in claim 1 wherein said frame is generally rectangular and has four arcuately bent corners and four straight sides between said corners, said butt joint being provided with a connecting element fitted into adjoining ends of members of the frame and plugging said ends to prevent loss of said drying agent therefrom.

8. The assembly defined in claim 7 wherein said tube is of generally rectangular cross section with a rigid surface forming an inner wall of the frame, a relatively thick wall constituting the outer wall of the frame, a pair of lateral walls adapted to engage said panes, and a pair of set-back edge portions adjacent said outer wall and adapted to define with said panes inwardly converging spaces for a sealing composition, said sealing composition filling said inwardly converging spaces.

9. The assembly defined in claim 8, further comprising an outer frame extending around said panes and the spacer and having frame aprons overhanging said panes, the bends forming said corners being of such radius that said corners are completely concealed by said outer frame.

10. A process for making a spacer for double-pane and multi-pane windows which comprises the steps of:

filling at least a portion of the length of an extrusion-pressed profile tube with a drying agent;

bending said length to form at least one 90° angle therein and provide an arcuate frame corner in a region of the tube filled with said drying agent by initially advancing said length against a stop and forming it with a 90° bend, advancing the bent length against a stop and forming a second 90° bend therein, and severing the resulting section formed with two 90° bends from the remainder of the tube; and assembling the bent lengths into a frame having a plurality of such corners and at least one butt joint between ends of the tube along a straight side of the frame.

11. The process defined in claim 1 wherein two extrusion-pressed profile tubes are bent simultaneously in side-by-side coextensive relationship.

12. The process defined in claim 10 wherein the bending is effected in a plane inclined to the horizontal.

13. A process for making a spacer for double-pane windows and multi-pane windows which comprises the steps of:

filling at least a portion of a length of an extrusion-pressed profile tube with a drying agent;

bending said length to form at least one 90° curved bend therein and provide an arcuate frame corner in a region of the tube filled with said drying agent;

severing said length of said tube from the remainder thereof;

vibrating the severed length of tube to shake said drying agent from a severed end thereof; and assembling the bent length with other bent lengths into a frame having a plurality of such corners and at least one butt joint between ends of said lengths along a straight side of the frame.

14. A process for making double-pane window and multi-pane window spacers which comprises the steps of:

filling at least a portion of a length of an extrusion-pressed profile tube with a drying agent;

bending said length to form at least one 90° angle thereof and provide an arcuate frame corner in a region of the tube filled with said drying agent;

severing said length of tube from another length thereof on a work table and bending said other length on said work table to form another arcuate frame corner; and assembling the bent lengths on said table into a frame having a plurality of such corners and at least one butt joint between ends of the tube lengths along the straight side of the frame.

* * * * *